United States Patent [19]

Pazurek

[11] Patent Number: 4,959,890

[45] Date of Patent: Oct. 2, 1990

[54] INTERCHANGEABLE SNAP BUTTON SYSTEM

[76] Inventor: Mary K. Pazurek, 5634 El Canon Ave., Woodland Hills, Calif. 91367

[21] Appl. No.: 418,880

[22] Filed: Oct. 10, 1989

[51] Int. Cl.[5] ..... A44B 1/04

[52] U.S. Cl. ..... 24/113 MP; 63/29.1

[58] Field of Search ..... 24/113 R, 113 MP, 90 R, 24/90 A, 92, 108, 90 TA; 63/DIG. 3, 29.1

[56] References Cited

U.S. PATENT DOCUMENTS

| | | | |
|---|---|---|---|
| 2,058,318 | 10/1936 | Johnson | 24/90 TA |
| 2,129,356 | 9/1938 | Kelly . | |
| 2,433,986 | 1/1948 | Forbes | 24/108 X |
| 2,715,253 | 8/1955 | Martin . | |
| 2,983,975 | 5/1961 | Hubbell | 24/113 MP |
| 3,979,802 | 9/1976 | Bougartz et al. . | |
| 4,495,678 | 1/1985 | Coley et al. | 24/113 R |

FOREIGN PATENT DOCUMENTS

| | | | |
|---|---|---|---|
| 1157121 | 5/1958 | France | 63/DIG. 3 |
| 96178 | 9/1922 | Switzerland | 24/113 R |
| 610274 | 10/1948 | United Kingdom | 24/113 MP |

*Primary Examiner*—James R. Brittain

*Attorney, Agent, or Firm*—Poms, Smith, Lande & Rose

[57] ABSTRACT

An interchangeable snap button system permits the user to change the appearance of a blouse, dress or jacket by changing the appearance of the buttons. A combined female snap member and button is formed of a conventional-type female snap member with a metal loop secured on the back thereof so it may be sewn onto a garment, serving as a button. Sets of different decorative members have male snap members bonded to them, and may be selectively snapped onto the female snap and button member. Earring clips may also have male snap members secured thereto to selectively receive the decorative members.

16 Claims, 1 Drawing Sheet

FIG. 1
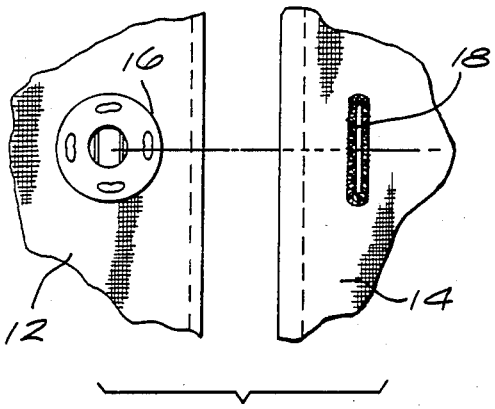
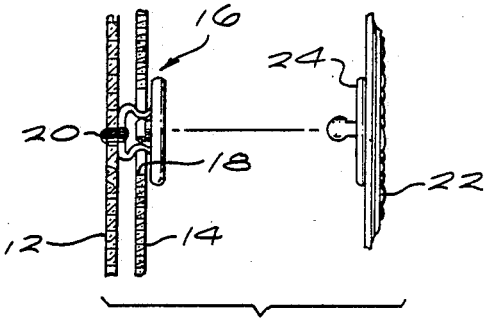
FIG. 2
FIG. 3
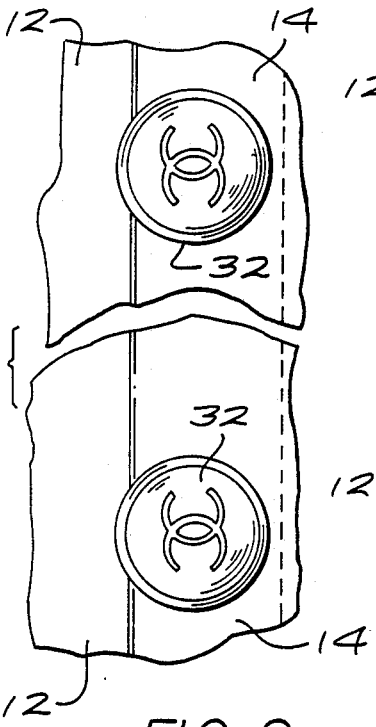
FIG. 4
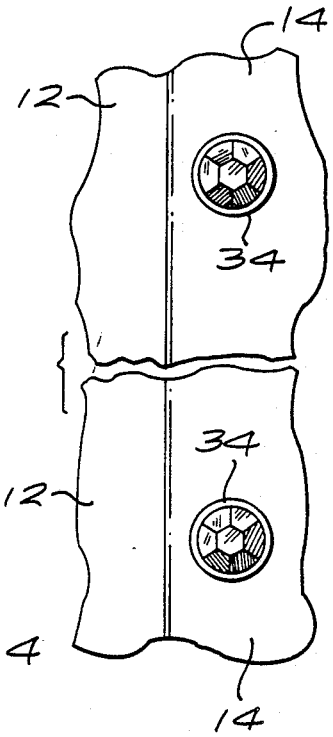
FIG. 5
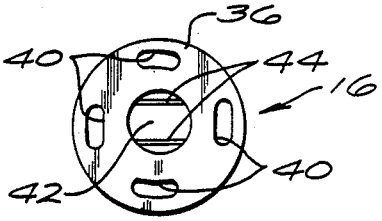
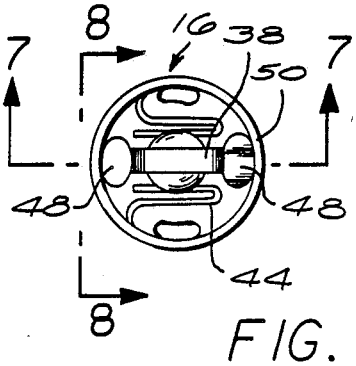
FIG. 6
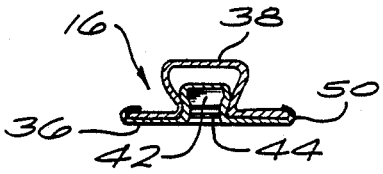
FIG. 7
FIG. 9
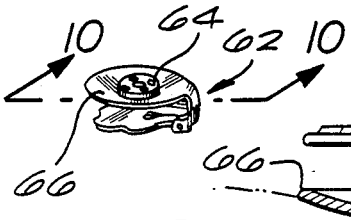
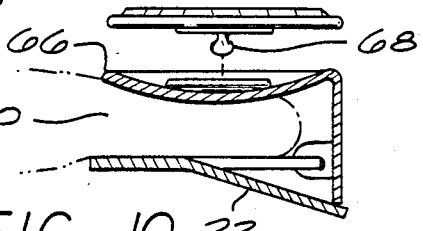
FIG. 10
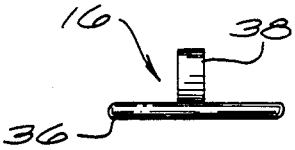
FIG. 8

INTERCHANGEABLE SNAP BUTTON SYSTEM

FIELD OF THE INVENTION

This invention relates to snap fasteners and decorative buttons.

BACKGROUND OF THE INVENTION

In order to hold the edges of garments such as shirts, blouses, dresses or jackets together, snap fasteners or buttons are commonly employed. Particularly with regard to ladies' blouses and dresses, buttons play an important part of the overall appearance of the garment. When relatively inconspicuous buttons are employed, a more severe and businesslike appearance is presented; while the use of fancy, elaborate and relatively large decorative buttons make a garment more suitable for dressy or leisure wear. Because of this difference, a woman may very often have somewhat similar blouses or dresses which differ only in the buttons used on the dress as to whether it is suitable for business occasions or for more dressy leisure time activities.

Accordingly, one important object of the present invention is to permit the transformation of a garment by the use of fasteners having an interchangeable external appearance.

Various prior art arrangements are shown in F. J. Kelly, U.S. Pat. No. 2,129,356; K. V. Martin, U.S. Pat. No. 2,715,253; T. G. Keller et al., U.S. Pat. No. 3,468,045; and K. B. Bongartz et al., U.S. Pat. No. 3,979,802. However, none of these patents constitutes a practical fastener system which may use decorative buttons of different sizes, and which is simple and convenient to use.

SUMMARY OF THE INVENTION

In accordance with the present invention, a female snap member of generally circular configuration is provided with a small loop extending from the rear of the snap and outward from the snap so that the female snap member itself may be secured by the loop onto a fabric material and act as a button. Then, interchangeable decorative members of a disc or other shape, may have conventional male-type snap members secured to them, and may be selectively attached to the female snap member after the female snap member has been passed through a mating buttonhole. In this way, the garment may have standard size buttonholes to fit the standard size female snap member which acts as a button to secure the two edges of the garment together, and decorative discs, which may be larger than the female snap member, may thereafter be attached to the female snap member to provide the desired appearance to the garment, either using conservative-style decorative members or larger dressy discs, according to the occasion where the garment is to be worn.

As an additional feature of the invention, standard earring clips may have female snap members bonded to them so that the decorative discs may be attached to form attractive earring assemblies.

Other objects, features and advantages of the invention will become apparent from a consideration of the following detailed description and from the accompanying drawings.

BRIEF DESCRIPTION OF THE DRAWINGS

FIG. 1 shows two mating edges of a garment, such as a blouse or dress, with a combined female snap member and button on one edge and a buttonhole on the other edge thereof;

FIG. 2 is a side view of the assembly of the present invention;

FIGS. 3 and 4 show two different types of decorative discs secured to the same garment, to provide different effects;

FIG. 5 is a top view of a female snap and button member, illustrating the principles of the invention;

FIG. 6 is a bottom view of the snap and button member of FIG. 5;

FIG. 7 is a side view of the member of FIGS. 5 and 6 taken from one orientation;

FIG. 8 is another side view of the member of FIGS. 5 and 6 taken from an orientation 90° shifted from that of FIG. 7;

FIG. 9 is an earring clip to which a female snap member is bonded; and

FIG. 10 is a cross-sectional view through the earring clip of FIG. 9.

DETAILED DESCRIPTION OF THE DRAWINGS

Referring more particularly to the drawings, FIG. 1 shows a garment having a first edge 12, and a second edge 14. Secured to the edge 12 of the garment is a female combined snap and button member 16, arranged to pass through the buttonhole 18.

A side view of all of the elements of the present invention is shown in FIG. 2 of the drawings. In FIG. 2, the combined snap and button members 16 is shown attached by the threads 20 to the edge 12 of the garment and, with its circular outer portion extending through the buttonhole 18. The decorative disc 22 has a male snap member 24 of conventional type glued or bonded to the rear surface of disc 22. The decorative disc 22 may be secured to the combined snap and button member 16 by snapping the conventional male snap member 24 into the snap member 16. In this way, a variety of decorative discs may be secured to the garment, with the appearance of the garment being changed by the type of decorative disc which is employed.

FIGS. 3 and 4 show the garment with the combined snap and button members holding the two edges 12 and 14 together, but with one type of decorative disc 32 of relatively large diameter being employed in the showing of FIG. 3; with a smaller type of decorative disc 34 being employed in the showing of FIG. 4 of the garment.

The details of the construction of the combined button and snap member 16 are shown in FIGS. 5 through 8. More specifically, FIG. 5 is a top view of the member; FIG. 6 is a bottom view of the same member; and FIGS. 7 and 8 are side views of the member taken from two different orientations. With reference to FIGS. 5 through 8 of the drawings, the combined snap and button member 16 is formed of a conventional female snap member 36 together with a metal loop 38 which is secured to the rear side of the conventional female snap member 36. The openings 40 around the periphery of the snap member 36 are conventional and are normally used to secure the snap member to the edge of a garment by sewing through the openings 40. The central opening 42 is employed to receive the male snap member, and small additional spring wire members 44 are normally present in order to provide additional holding for the male snap member as shown at 24 in FIG. 2 of the drawings.

The metal loop 38 has out-turned ends 48 which may extend under the inturned lip 50 of the conventional female strap portion 36, and the out-turned ends 48 may then be bonded to the remainder of the assembly by soldering, by bonding with epoxy glue or the like, or in any other desired manner.

FIG. 7 is a side view of the assembly of FIGS. 5 and 6 taken from the orientation 7—7 of FIG. 6. The elements described hereinabove, including the conventional female snap member 36 and the metal loop 38, are clearly shown in FIG. 7. FIG. 8 is taken in the orientation indicated by the by the arrows 8—8 of FIG. 6, perpendicular to the showing of FIG. 7. This showing also includes the metal loop 38 and the conventional female snap portion 36.

FIGS. 9 and 10 show an earring clip to which the decorative members 22, 32 or 34 of FIGS. 2, 3 or 4, respectively, may be attached. In FIGS. 9 and 10, a standard commercially available earring clip 62 has a female snap member 64 glued or otherwise bonded thereto. The clip 62 has a slightly dished portion 66 through which a hole may be drilled or punched to provide clearance for the protruding portion 68 of the female snap member 64. In FIG. 10, the reference numeral 70 schematically identifies an earlobe to which the clip 62 is attached by the conventional over-center clip mechanism 72.

The special earring clip of FIGS. 9 and 10 permits the user to wear the decorative discs 22, 32 or 34 as earrings, when they are not being used on a garment. This alternative use is desired as the decorative discs are often moderately expensive so that multiple uses are welcome.

In conclusion, it should be understood that the foregoing detailed description relates to one preferred embodiment of the invention, and that various changes and modifications may be made without departing from the spirit and scope of the invention. Thus, by way of example and not of limitation, the male and female snap members may be formed of plastic instead of metal, and the loop 38 may also be formed of high-strength plastic, in combination with a metal conventional female snap member, if desired. Also, the opening 40 as shown in FIG. 5 need not be provided if the parts would be less expensive without these openings. It is further noted that the decorative members 32 and 34, as shown in FIGS. 3 and 4, for example, may be of a configuration other than circular, such as oval or diamond shaped, if desired. It may also be noted that the positions of the male and female snap members may be reversed, if desired, with the male member being provided with the additional loop and serving as a button, instead of the female member. Accordingly, the present invention is not limited to the configuration precisely as shown in the drawings and as described hereinabove.

What is claimed is:

1. An interchangeable snap button system comprising:

a snap and button member of generally circular configuration of a predetermined diameter, having a front side thereof, and having a small loop extending from the rear thereof, said loop having a transverse extent which is not greater than said diameter;

a garment having a first edge to be buttoned to a second edge;

means securing said first snap and button member to said garment by said loop adjacent said first edge;

said garment having a buttonhole adjacent said second edge, with the extent of said buttonhole being slighly greater than said predetermined diameter, whereby said first snap member may be buttoned through said buttonhole with said loop extending through the hole; and a decorative member having an extent greater than said predetermined diameter and greater than the extent of said buttonhole so that said decorative member cannot pass through said buttonhole, and having a second mating snap member secured thereto, for mating with said first snap and button member after said first snap member is buttoned through said buttonhole, to provide a decorative outer display for selective attachment to said first snap and button member.

2. A system as defined in claim 1 wherein said first snap and button member includes a standard metal female snap member as the front portion thereof.

3. A system as defined in claim 2 wherein said female snap and button member includes the following:

a generally flat circular metal member having a snap opening on the front side thereof;

said metal member having an outer edge which is bent over to the rear and inward to provide a smooth curved outer periphery; and a small loop secured to the back of said metal member, and having its ends secured to said metal member at the outer edges of said circular metal member, said metal member having a transverse extent substantially less than the diameter of said circular metal member;

whereby said combined snap and button member may be secured to fabric by said loop, and said flat circular metal member may be utilized as a button to extend through a mating buttonhole.

4. A system as defined in claim 1 including a plurality of differrent types of decorative members for selectively changing the appearance of said garment.

5. A system as defined in claim 1 wherein said decorative member is circular.

6. A system as defined in claim 1 including a plurality of said first snap and button members extending along one edge of said garment, and a corresponding plurality of button holes extending along the second edge thereof.

7. A system as defined in claim 6 further comprising a first set of similar decorative members of one type to give said garment a first appearance, and a second set of similar decorative members of a significantly different type to give said garment of significantly different appearance.

8. A system as defined in claim 1 wherein said loop is formed of metal.

9. A system as defined in claim 1 further including an earring clip having a snap member secured thereto with a snap mechanism of the same size as that on said first snap and button member to selectively receive one of said decorative members.

10. An interchangeable snap button system comprising:

a plurality of female snap and button members of generally circular configuration of a predetermined diameter, each having a snap opening at the front side thereof, and having small loop extending from the rear thereof, said metal loop having a transverse extent not greater than said diameter;

a garment having a first edge to be buttoned to a second edge;

means securing a plurality of said female snap and button members to said garment by said loop adjacent said first edge;

said garment having a plurality of buttonholes adjacent said second edge, with the extent of each said buttonhole being slightly greater than said predetermined diameter, whereby said female snap and button members may be buttoned through said buttonholes with said loop extending through the holes; and first and second sets of distinctly different decorative members, each having an extent greater than said predetermined diameter and greater than the extent of said button holes so that said decorative members cannot pass through said button holes, and having a male snap member secured thereto, for mating with said female snap and button members after said male snap members are buttoned through said button holes to provide alternative decorative outer displays for selective attachment to said female snap members, to change the appearance of said garment.

11. A system as defined in claim 10 wherein said female snap and button members each include a standard metal female snap member as the front portion thereof.

12. A system as defined in claim 10 wherein said decorative members are circular.

13. A system as defined in claim 10 further including at least two earring clips each having a female snap member secured thereto, with a snap mechanism of the same size as that on said first snap and button member to selectively receive one of said decorative members.

14. A system as defined in claim 10 wherein said female snap and button members each include the following:

a generally flat circular metal member having a snap opening on the front side thereof;

said metal member having an outer edge which is bent over to the rear and inward to provide a smooth curved outer periphery; and a small loop secured to the back of said metal member, and having its ends secured to said metal member at the outer edges of said circular metal member, said metal member haivng a transverse extent substantially less than the diameter of said circular metal member;

whereby said combined snap and button member may be secured to fabric by said loop, and said flat circular metal member may be utilized as a button to extend through a mating buttonhole.

15. A system as defined in claim 10 wherein said loop is formed of metal.

16. An interchangeable snap button system comprising:

a first snap and button member of generally circular configuration of a predetermined diameter, having a front side thereof, and having a small loop extending from the rear thereof, said loop having a transverse extent which is not greater than said diameter;

a garment having a first edge to be buttoned to a second edge;

means securing said first snap and button member to said garment by said loop adjacent said first edge;

said garment having a buttonhole adjacent said second edge, with the extent of said buttonhole being slightly greater than said predetermined diameter, whereby said first snap member may be buttoned through said buttonhole with said loop extending through the hole;

a decorative member having an extend greater than said predetermined diameter, and greater than the extent of said buttonhole so that said decorative member cannot pass through said buttonhole, and having a second mating snap member secured thereto, for mating with said first snap and button member after said first snap member is buttoned through said buttonhole, to provide a decorative outer display for selective attachment to said first snap and button member; and at least one earring clip having a snap member secured thereto, with a snap mechanism of the same size as that on said first snap and button member for selectively receiving and mounting said decorative member on said clip.

* * * * *